US010709188B2

(12) United States Patent
Tedder et al.

(10) Patent No.: US 10,709,188 B2
(45) Date of Patent: Jul. 14, 2020

(54) METAL REINFORCED BELT

(71) Applicant: Tedder Industries, LLC, Hayden, ID (US)

(72) Inventors: Thomas Tedder, Hayden, ID (US); Timothy Treto, Mead, WA (US)

( * ) Notice: Subject to any disclaimer, the term of this patent is extended or adjusted under 35 U.S.C. 154(b) by 529 days.

(21) Appl. No.: 15/214,227

(22) Filed: Jul. 19, 2016

(65) Prior Publication Data

US 2018/0020755 A1 Jan. 25, 2018

(51) Int. Cl.

| | |
|---|---|
| ***A41F 1/00*** | (2006.01) |
| ***A41F 9/00*** | (2006.01) |
| ***A45F 5/02*** | (2006.01) |
| ***F41C 33/04*** | (2006.01) |

(52) U.S. Cl.

CPC ..... *A41F 9/002* (2013.01); *A45F 5/021* (2013.01); *F41C 33/046* (2013.01); *A45F 2200/0575* (2013.01); *A45F 2200/0591* (2013.01)

(58) Field of Classification Search

CPC ..... A41F 9/002

See application file for complete search history.

(56) References Cited

U.S. PATENT DOCUMENTS 1,358,589 A * 11/1920 Sharp ..... A41D 13/046 2/339
1,378,207 A * 5/1921 Awner ..... A41F 9/00 2/312
1,474,190 A * 11/1923 Fox ..... A41F 9/00 2/256
2,614,261 A * 10/1952 McTighe ..... A41D 27/02 2/255
2,830,300 A * 4/1958 Schwartz ..... A41C 1/20 2/257
3,030,633 A * 4/1962 Chalfin ..... A41C 1/14 2/258
3,042,932 A * 7/1962 Eppy ..... A41F 9/00 2/220
3,194,242 A * 7/1965 Marchisella ..... A41C 1/00 2/258
3,394,410 A * 7/1968 Liebowitz ..... A41C 1/14 2/260.1
3,638,241 A * 2/1972 Holmes ..... A41D 3/08 2/88
4,688,271 A * 8/1987 Capelle ..... A41F 9/00 2/220
5,170,503 A * 12/1992 Hightower, Jr. ..... A41D 17/02 2/22
5,426,791 A * 6/1995 Sydor ..... A61F 5/026 2/255
5,867,836 A * 2/1999 Quinones ..... A41F 9/02 2/221
6,253,384 B1 * 7/2001 Valentino ..... A41F 9/00 2/229
6,526,597 B1 * 3/2003 Shepard ..... A41F 9/00 2/236
6,986,165 B2 * 1/2006 Neff ..... A41B 1/12 2/129

(Continued)

*Primary Examiner* — Richale L Quinn

(74) *Attorney, Agent, or Firm* — Timberline Patent Law Group

(57) ABSTRACT

Representative implementations of devices and techniques provide a belt for carrying a weapon, tool, or other implement. The belt includes a reinforcement portion to provide rigidity to the belt for carrying heavy objects.

14 Claims, 5 Drawing Sheets

(56) References Cited

U.S. PATENT DOCUMENTS

| | | | | |
|---|---|---|---|---|
| 7,653,950 | B2 * | 2/2010 | Johnson | A41F 17/04 2/232 |
| 7,861,324 | B2 * | 1/2011 | Chetelat | A41F 9/00 2/231 |
| 8,950,014 | B2 * | 2/2015 | Schottenstein | A41B 3/06 2/132 |
| 9,320,302 | B2 * | 4/2016 | English | A41B 3/06 |
| 9,622,512 | B2 * | 4/2017 | Partsch, IV | A41B 1/20 |
| 9,775,393 | B2 * | 10/2017 | Miktuk | A41D 27/06 |
| 2003/0056271 | A1 * | 3/2003 | Graves | F41H 1/02 2/2.5 |
| 2004/0083525 | A1 * | 5/2004 | Wells, Jr. | A41D 1/06 2/2.5 |
| 2008/0177210 | A1 * | 7/2008 | McDevitt | A01K 13/007 602/23 |
| 2009/0013451 | A1 * | 1/2009 | Baxter | A41B 9/001 2/455 |
| 2016/0143374 | A1 * | 5/2016 | Thompson | A41D 13/0015 2/69 |
| 2017/0303604 | A1 * | 10/2017 | Kasabo | A41D 1/06 |
| 2018/0271186 | A1 * | 9/2018 | Milling | A41D 31/0061 |

* cited by examiner

METAL REINFORCED BELT

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished. In some cases, such as with a handgun for example, the holster may allow the user to conceal the implement, or to conceal the fact that the user is carrying the implement.

In some situations, the user may desire to carry the implement at the waistband of the user's clothing, to conceal the implement or for other reasons (such as for easy access, for example). In such situations, the holster may be attached to the user's belt, either inside or outside of the waistband of the user's trousers. In many cases, the belt is constructed of a medium to heavy leather material (or the like). Still, the belt may not provide sufficient rigidity or stability to support the holster and the implement. Further, the weight of the implement and the holster may pull on the user's clothing, causing the clothing to sag or to move to an undesired position.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Introduction

Figure 1:
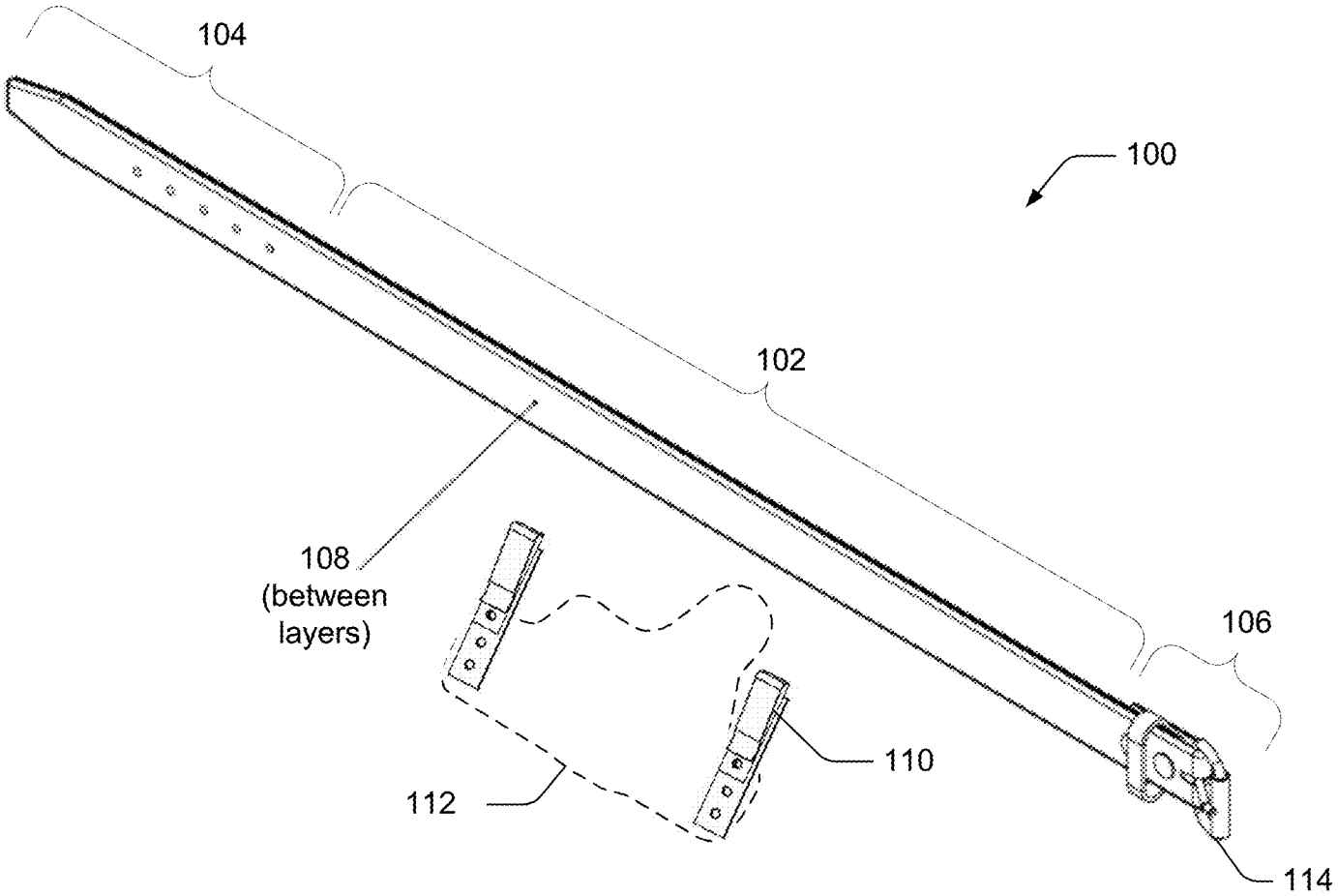
FIG. 1 is a perspective view of an example reinforced belt, according to an embodiment.

Representative implementations of devices and techniques provide a metal reinforced belt ("belt") for carrying a weapon, tool, or other implement. The belt portion is comprised of multiple layers. The layers may be combined to provide various desired characteristics for the belt, such as strength, comfort, resilience, utility, weight, and so forth. For instance, outer layers may provide comfort and durability while layers between the outer layers may provide strength and rigidity. In many examples, all layers may contribute to desired strength characteristics and resilience.

In an implementation, the belt includes a reinforcement portion (layer) comprising a metal, a metal alloy, a metallic composite, other composite(s), or the like. In another implementation, the reinforcement portion of the belt includes multiple metallic layers. In the implementations, the reinforcement layer or layers provides rigidity while allowing the belt to conform to the user's body. For example, the reinforcement layer or layers prevents the belt from deforming, thus giving the belt the capability to carry heavy loads without sagging.

In some embodiments, the inner metallic layer may include one or more features, which provide desired rigidity characteristics to the belt or facilitate the inner metallic layer's adhesion to the outer belt layers. In various implementations, the reinforcement portion extends the full length of the belt, except for the adjustment portion of the belt (with the holes for the buckle to interface to). In other implementations, the reinforcement portion extends within partial sections of the belt, providing varying degrees of rigidity to predetermined areas of the belt.

Techniques and devices are discussed with reference to example handgun belts and holsters illustrated in the figures. However, this is not intended to be limiting, and is for ease of discussion and illustrative convenience. The techniques and devices discussed may be applied to a belt arranged to support any of various cases, case designs, combinations, and the like, (e.g., holsters, sheaths, covers, cases, carriers, scabbards, etc.) for encasing tools, weapons, or other equipment or implements, and remain within the scope of the disclosure.

Further, the techniques and devices are discussed and illustrated generally with reference to a concealed carry style holster. This is also not intended to be limiting. In various implementations, the techniques and devices may be employed with inside waistband (IWB) holsters, outside waistband (OWB) holsters as well as holsters that may be worn in various ways using a belt. In alternate implementations, the techniques and devices may be employed in other ways or with other devices, systems, instruments, or the like.

Implementations are explained in more detail below using a plurality of examples. Although various implementations and examples are discussed here and below, further implementations and examples may be possible by combining the features and elements of individual implementations and examples.

Example Reinforced Belt

Referring to FIGS. 1 through 5, an example reinforced belt ("belt") 100 is shown and described in several non-limiting example configurations. In various embodiments, as shown in the FIGS. 1-4, a belt 100 includes a multi-layered belt portion 102, an adjustment portion 104, a closure portion 106, and a reinforcement portion 108 disposed between layers of the belt portion 102. In alternate embodiments, the belt 100 may include additional or alternate components or features.

For example, as shown in FIG. 1, in various implementations, attachment devices 110 can temporarily or permanently couple an implement holster component 112 to the belt portion 102. Attachment devices 110 can include hooks, clips, rivets, snap-type fasteners, screw and nut fasteners, or the like. In some implementations, the holster component 112 may be an option on the belt 100, and the belt 100 and the holster component 112 may be combined as a single system, such as a holster belt assembly, for example.

In an implementation, the belt portion 102 is wrapped around the body of a user. For instance, the belt portion 102 may be wrapped around the midsection of the body of the user when the belt 100 is worn by the user (e.g., when the belt 100 is worn at the waist of the user). The adjustment portion 104 is interfaced with the closure portion 106 to couple the ends of the belt 100, securing the belt 100 to the user. In other examples, the belt portion 102 may be wrapped around another body portion of the user (e.g., around the hips, across the chest and/or shoulder, etc.) as desired, and the belt 100 secured in like manner.

Figure 3:
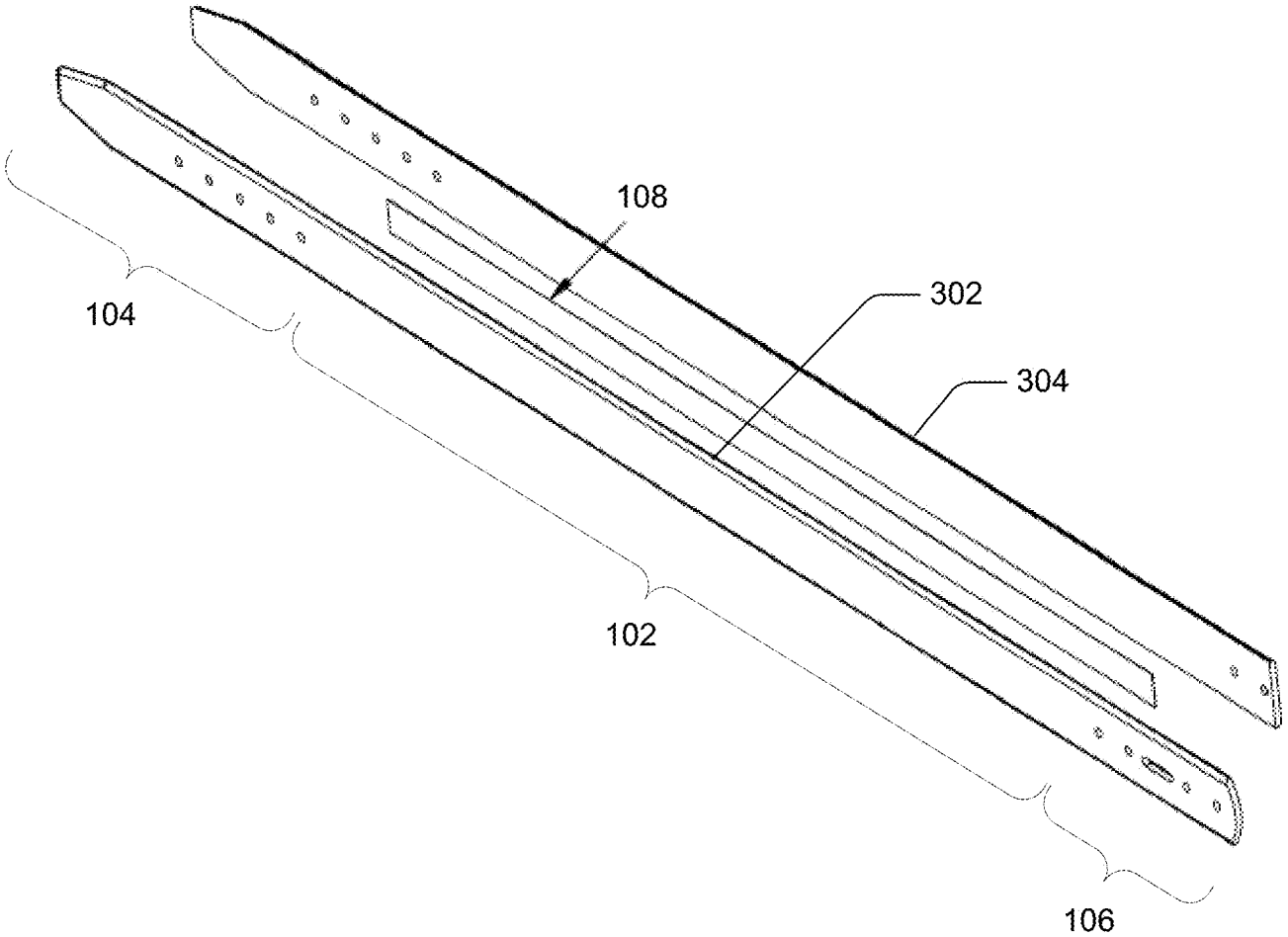
FIG. 3 is an exploded view of the reinforced belt of FIG. 1, according to an embodiment.
Figure 4:
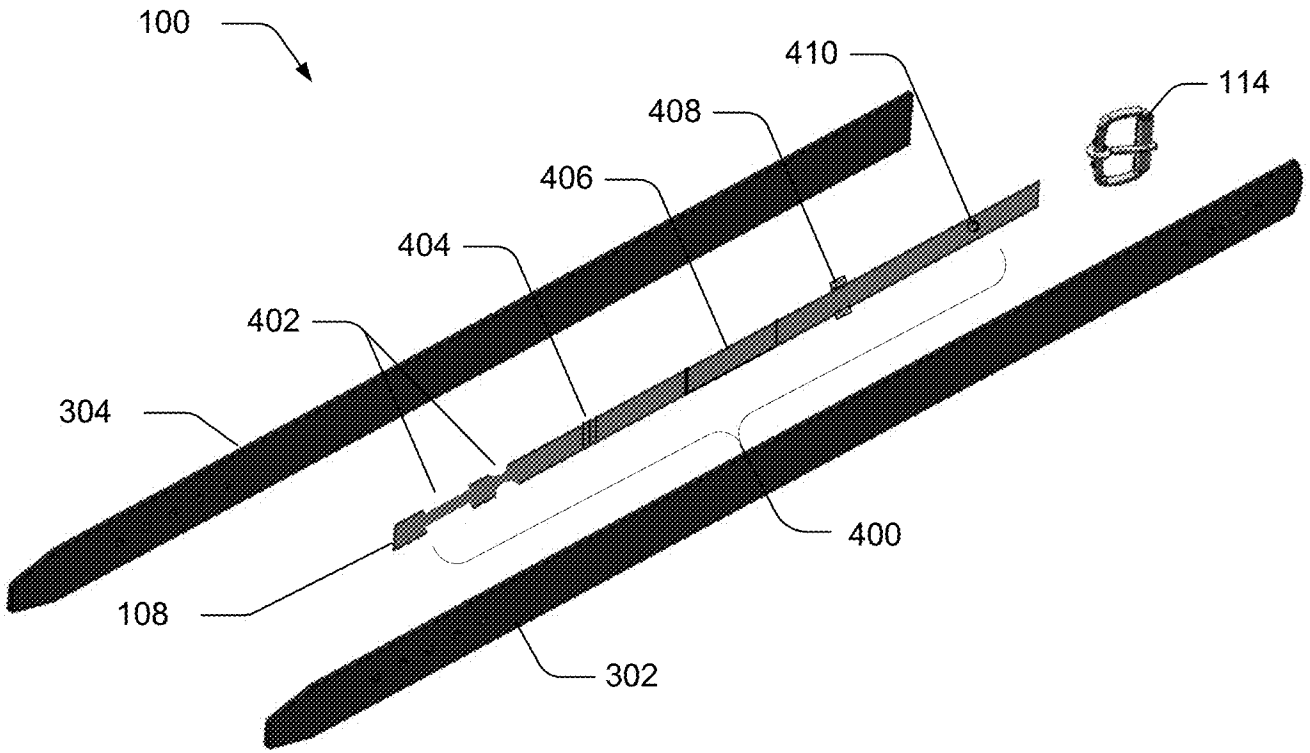
FIG. 4 is an exploded view of a reinforced belt, according to another embodiment.

In various implementations, as shown in FIGS. 3, and 4, the belt portion 102 is comprised of multiple layers (302, 304). For example, the belt portion 102 may be comprised of two or more parallel layers (302, 304) coupled together (e.g., with adhesive, stitching, fasteners, etc. or a combination of the same). In one implementation, the multiple layers (302, 304) comprise at least two different materials. In an embodiment, one or both layers of the multiple layers (302, 304) comprises a substantially non-elastic material (e.g., a nylon material, a para-aramid or aramid material, a fiberglass material, a metallic material, an animal hide, synthetic leather, or the like).

In an implementation, the belt 100 includes a reinforcement portion 108 comprising a metallic layer disposed between at least two layers of the belt portion 102. In the implementation, the metallic layer provides rigidity and stability to the belt portion 102. In various embodiments, the reinforcement portion 108 may have various configurations and arrangements, and may be comprised of one or more of various materials to provide the desired rigidity and stability, according to various applications. In various embodiments, the reinforcement portion 108 is comprised of a metal, a metal alloy, a metallic composite, or the like. For example, in one embodiment, the reinforcement layer 108 comprises a spring steel layer, or the like.

In some implementations, the thickness and the width of the reinforcement portion 108 is consistent along the length of the reinforcement portion 108. For instance, in an embodiment, a metallic layer of the reinforcement portion 108 is 0.010" thick. However, in some embodiments, the thickness or the width of the reinforcement portion 108 varies along the length of the reinforcement portion 108, according to a predetermined pattern. In the embodiments, the variation of thickness and width determines the rigidity or the flexibility of the reinforcement portion 108 according to the predetermined pattern. For example, the reinforcement portion 108 may be more narrow and/or be thinner (lighter gauge) at an area of the belt 100 where more flexibility is desired, and may be more wide and/or be thicker (heavier gauge) at an area of the belt 100 where more rigidity is desired.

In various embodiments, the reinforcement portion 108 extends the full length of the belt portion 102. In one example, the reinforcement portion 108 extends from the closure portion 106 to the adjustment portion 104. In another example, the reinforcement portion 108 extends somewhat into the closure portion 106 and/or the adjustment portion 104. In an alternate example, the reinforcement portion 108 extends fully along a length of the belt 100 through the closure portion 106 and the adjustment portion 104. In the example, the material of the reinforcement portion 108 may vary from portion to portion (102, 104, 106) of the belt 100.

In an embodiment, the reinforcement portion 108 extends a partial length (or multiple partial lengths) of the belt portion 102. In the embodiment, the partial length(s) of the reinforcement portion 108 are arranged to provide reinforcement at one or more predetermined areas of the belt portion 102 where additional stability or rigidity is desired. For instance, in one embodiment, the reinforcement portion 108 comprises multiple segments of the metallic layer, disposed between at least two layers (e.g., 302 and 304) of the belt portion 102.

In some embodiments, the reinforcement portion 108 comprises a plurality of metallic layers disposed between layers of the belt portion 102. For instance, the plurality of metallic layers may all be disposed between one set of layers (e.g., layers 302 and 304) of the belt portion 102, or the plurality of metallic layers may be dispersed between different layers of the belt portion 102 (e.g., when the belt portion 102 includes more than 2 layers).

In one embodiment having a multi-layer reinforcement portion 108, the plurality of metallic layers of the reinforcement portion 108 is comprised of layers of different materials. For instance, the reinforcement portion 108 may include a layer of steel and a layer of titanium, or it may include a layer of titanium and a layer of polycarbonate, and so forth. In the embodiment, the selection and placement of the materials can result in the desired rigidity characteristics for the belt 100. Alternately, the material of each layer of the reinforcement portion 108 may be the same.

Referring to FIG. 4, in various implementations, one or more features 400 may be formed into at least a part of one or more surfaces, one or more edges, or one or more surfaces and one or more edges of the reinforcement portion 108. In the implementations, the one or more features 400 can increase or decrease a rigidity of the part of the reinforcement portion 108, based on the shape and the orientation of the one or more features 400.

For example, the one or more features 400 may comprise one or more regions (e.g., 402) where material is removed from a part of one or more surfaces and/or one or more edges of the reinforcement portion. Alternately, the one or more features 400 may comprise one or more regions (e.g., 406, 408, 410) where material is added to a part of one or more surfaces and/or one or more edges of the reinforcement portion 108. For instance, the one or more features 400 can comprise one or more regions (e.g., 406) where an additional layer is added to the reinforcement portion 108.

In other embodiments, the one or more features 400 may comprise ridges (e.g., 404), tabs (e.g., 408), bumps (e.g., 410), or any other alteration to the material of the reinforcement portion 108. In addition to adjusting the rigidity or flexibility of the reinforcement portion 108, in some cases the one or more features 400 can increase or decrease a friction of the at least a part of the reinforcement portion 108 based on a shape and an orientation of the one or more features 400.

Figure 2:
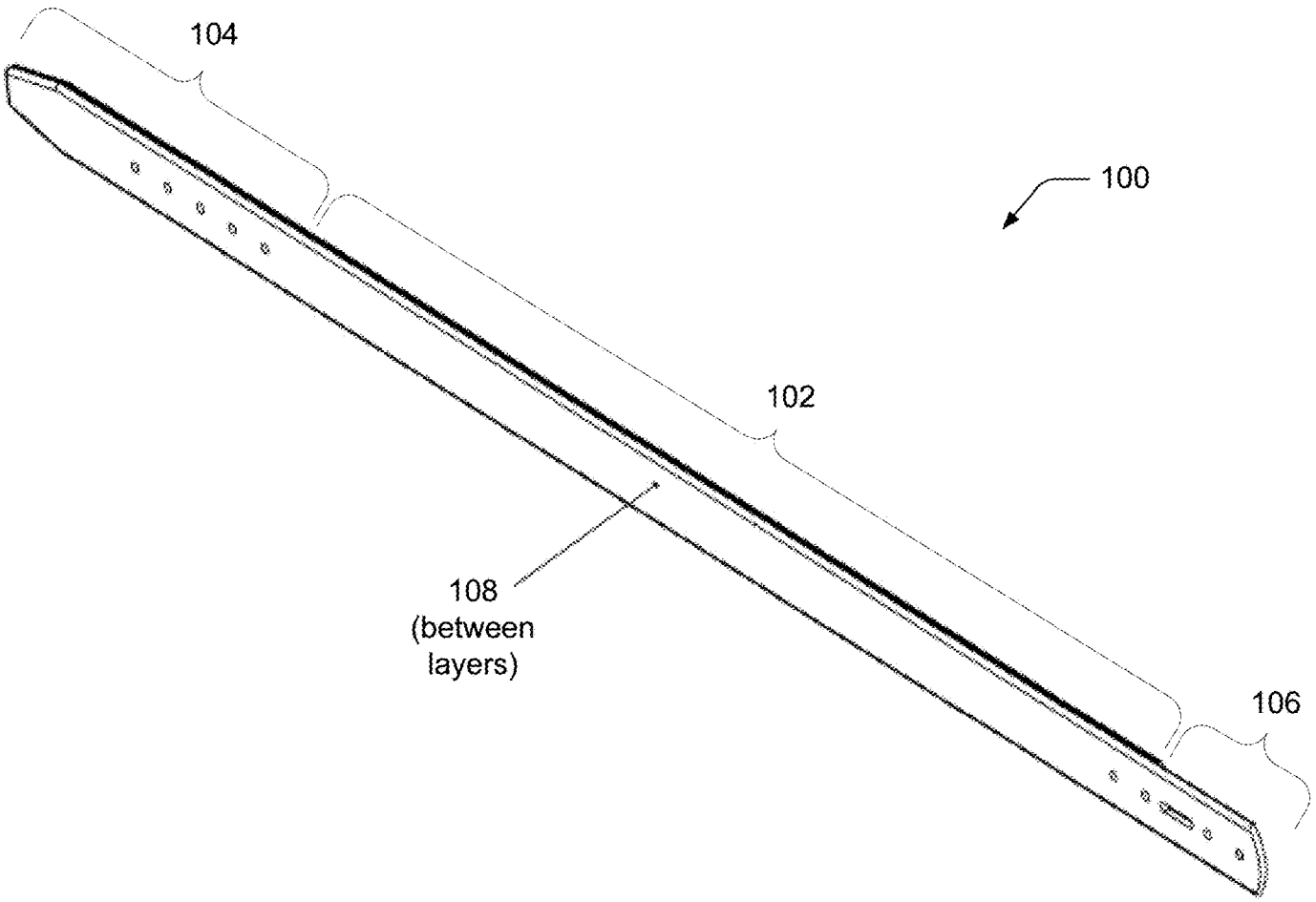
FIG. 2 is a perspective view of the reinforced belt of FIG. 1, shown without a buckle, according to an embodiment.

Referring to FIGS. 1-3, in an implementation, the adjustment portion 104 is disposed at a first end of the belt portion 102, and is arranged to interface with the closure portion 106 to couple the ends of the belt 100. In various embodiments, the adjustment portion may include various functional features (e.g., belt holes, hook and loop fastener, snaps, etc.) for interfacing with the closure portion 106 in an adjustable manner to couple the ends of the belt 100.

In various embodiments, as shown in FIGS. 3 and 4, the adjustment portion 104 may be comprised of two or more layers. In some embodiments, the layers (302, 304) of the belt portion 102 extend continuously through the adjustment portion 104. In one embodiment, the reinforcement portion 108 extends partially or fully through the adjustment portion 104. In one example, one or more metallic layers are disposed between the layers of the adjustment portion 104, while allowing the adjustment portion 104 to bend or articulate with respect to the closure portion 106. For instance, the metallic layers may be disposed on either side of the belt holes, the metallic layers may be smaller sections between the belt holes, the belt holes may be formed through the sections of the reinforcement portion 108, or the like.

Referring to FIGS. 1 and 4, in an implementation, the closure portion 106 is coupled to a second end of the belt portion 102. The closure portion 106 is arranged to interface with the adjustment portion 104 to temporarily couple together the adjustment portion 104 and the second end of the belt portion 102 when the belt portion 102 is wrapped around the user. The closure portion 106 may have various functional features (such as belt buckle 114, hook and loop fastener, a clasp device, etc., for example) for interfacing with the adjustment portion 104 in an adjustable manner to couple the ends of the belt 100.

In various embodiments, as shown in FIGS. 3 and 4, the closure portion 106 may include two or more layers of material in addition to the functional features. In some embodiments, the layers (302, 304) of the belt portion 102 extend continuously through the closure portion 106. In one embodiment, the reinforcement portion 108 extends partially or fully through the closure portion 106. In one example, one or more metallic layers are disposed between the layers of the closure portion 106. For instance, the metallic layers may be arranged around openings in the closure portion 106, the openings may be formed through the reinforcement portion 108, or the like.

The components and techniques discussed herein with respect to the belt 100 are intended to be used in the production of new holster belts or in the retro-fitting of existing holsters. In various embodiments, existing holsters may be upgraded or re-fitted with a belt 100 using one or more of the described techniques either individually or in various combinations. In an embodiment, the use of the described components and techniques result in holster belts with increased stability and rigidity. Further, such holster belts may be configured and/or adjusted for various user wearing or carry options and locations.

The techniques, components, and devices described herein with respect to the implementations are not limited to the illustrations of FIGS. 1-4, and may be applied to other belts, holster components and devices, and case designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a belt 100 may be implemented as a stand-alone device (without a holster component 112) or as part of a system (e.g., integrated with other components, including for example a holster component 112, as described above). In various implementations, additional or alternative components may be used to accomplish the disclosed techniques and arrangements.

Representative Process

Figure 5:
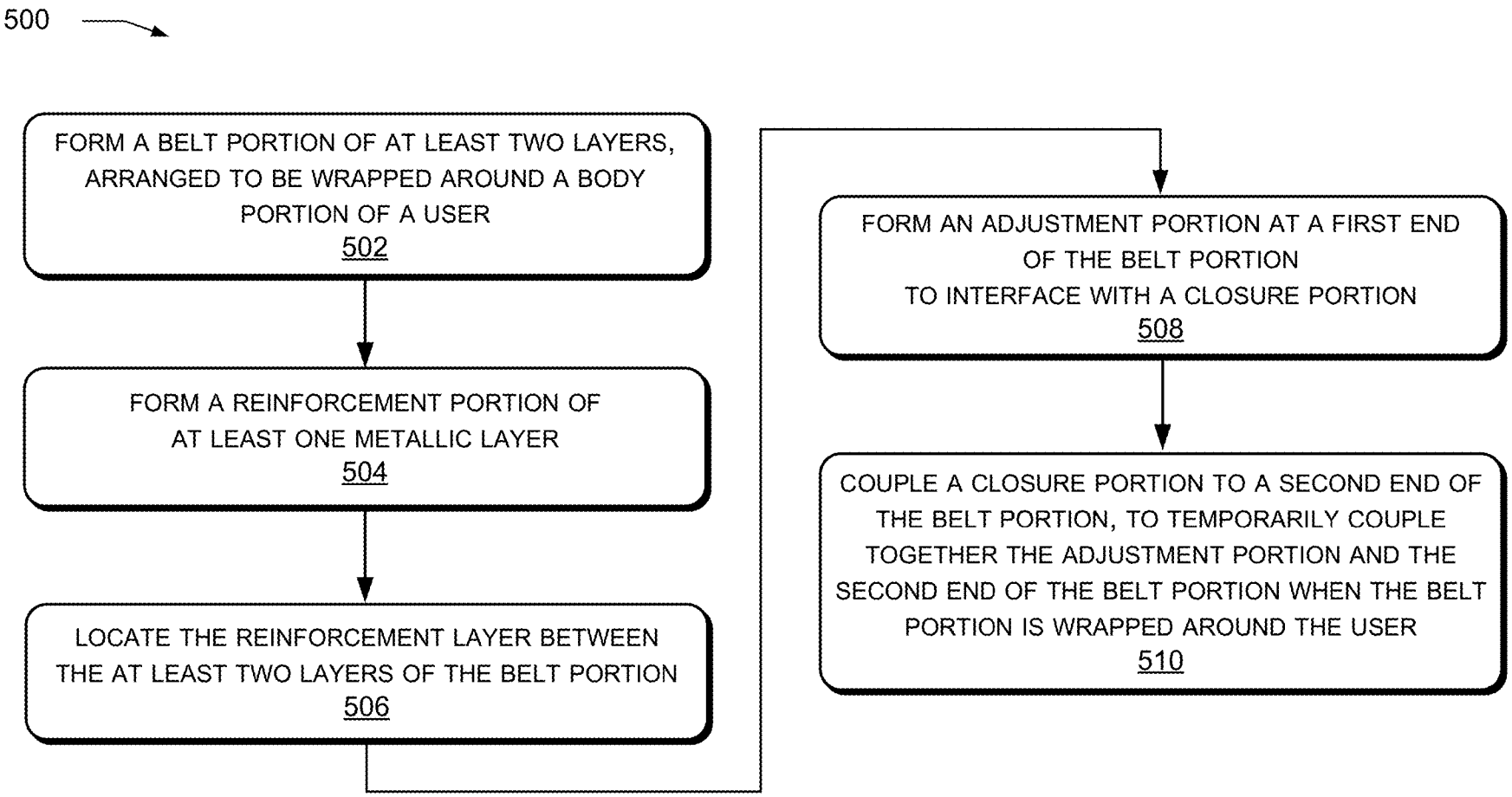
FIG. 5 illustrates a flow diagram of a method of forming a reinforced belt, according to an implementation.

FIG. 5 is a flow diagram illustrating an example method 500 for forming a reinforced belt (such as belt 100, for example), according to various implementations. The process 500 is described with reference to FIGS. 1-4.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 502, the process includes forming a belt portion (such as belt portion 102, for example) of at least two layers, arranged to be wrapped around a body portion of a user. In various embodiments, the belt portion may be formed of animal hide, synthetic materials, or the like.

At block 504, the process includes forming a reinforcement portion (such as reinforcement portion 108, for example) of at least one metallic layer. For instance, the reinforcement portion may be formed of a spring steel layer, or the like. In some embodiments, the process includes forming the reinforcement portion of a plurality of metallic layers. In one embodiment, the process includes forming the reinforcement layer of at least one metallic layer. In an implementation, the process includes extending the reinforcement portion a length of the belt portion. In other embodiments, the reinforcement portion extends one or more partial lengths of the belt portion.

In another implementation, the process includes varying a thickness or a width of the reinforcement portion along a length of the reinforcement portion according to a predetermined pattern. The rigidity or the flexibility of the reinforcement portion is determined according to the predetermined pattern.

In one implementation, the process includes forming one or more features (such as features 400, for example) into at least a part of one or more surfaces, one or more edges, or one or more surfaces and one or more edges of the reinforcement portion. The one or more features have a preselected shape and orientation. The process includes increasing or decreasing a rigidity of the part of the reinforcement portion based on the shape and the orientation of the one or more features. In various embodiments, the one or more features may include removing material or adding material to the metallic layer(s) of the reinforcement portion, forming tabs, bumps, or ridges to the metallic layer(s), adding additional layers, and the like. In various implementations, the one or more features comprise one or more protrusions and/or cavities arranged at a preselected orientation and having a preselected shape.

In one example, the process includes adjusting one or more portions of the reinforcement portion by adding material to or removing material from one or more surfaces, one or more edges, or one or more surfaces and one or more edges of the reinforcement portion. For instance, a portion may be adjusted to be more flexible by removing material and a portion may be adjusted to be more rigid by adding material to the portion of the metallic layer(s) of the reinforcement portion.

At block 506, the process includes locating the reinforcement layer between the at least two layers of the belt portion. The process includes tuning a flexibility and a rigidity of the belt portion based on selecting a material, a thickness, and a shape of the reinforcement portion.

At block 508, the process includes forming an adjustment portion at a first end of the belt portion to interface with a closure portion. At block 510, the process includes coupling a closure portion to a second end of the belt portion, to temporarily couple together the adjustment portion and the second end of the belt portion when the belt portion is wrapped around the user.

In alternate implementations, other techniques may be included in the process 500 in various combinations, and remain within the scope of the disclosure.

Conclusion

While various discreet embodiments have been described throughout, the individual features of the various embodiments may be combined to form other embodiments not specifically described. The embodiments formed by combining the features of described embodiments are also within the scope of the disclosure.

What is claimed is:

1. An apparatus, comprising:

a multi-layered belt arranged to be wrapped around a midsection body portion of a user, the multi-layered belt comprising a plurality of parallel strips coupled together in an aligned stack, including:

two parallel outer layers with their respective profiles aligned together, and one or more inner layers sandwiched between the two outer layers and enclosed by the two outer layers, wherein the one or more inner layers includes at least one metallic layer and comprises a reinforcement portion;

an adjustment portion disposed at a first end of the belt, comprising a plurality of holes that penetrate through the two parallel outer layers and are arranged to interface with a closure portion; and a closure portion coupled at a second end of the belt, comprising a buckle, wherein a portion of the buckle is arranged to protrude through one or more of the plurality of holes to temporarily couple together the adjustment portion and the second end of the belt, wherein the at least one metallic layer extends continuously from the adjustment portion to the closure portion.

2. The apparatus of claim 1, wherein the reinforcement portion comprises a plurality of metallic layers disposed between and enclosed by the two outer layers of the belt.

3. The apparatus of claim 2, wherein the plurality of metallic layers is comprised of layers of different materials.

4. The apparatus of claim 1, further comprising one or more features formed into at least a part of one or more surfaces, one or more edges, or one or more surfaces and one or more edges of the reinforcement portion, the one or more features increasing or decreasing a rigidity of the part of the reinforcement portion based on a shape and an orientation of the one or more features.

5. The apparatus of claim 4, wherein the one or more features comprise one or more regions where material is removed from or material is added to the at least a part of one or more surfaces, one or more edges, or one or more surfaces and one or more edges of the reinforcement portion.

6. The apparatus of claim 4, wherein the one or more features comprise one or more regions where an additional layer is added to the reinforcement portion.

7. The apparatus of claim 4, wherein the one or more features increase or decrease a friction of the at least a part of the reinforcement portion based on a shape and an orientation of the one or more features.

8. The apparatus of claim 1, wherein the reinforcement portion extends a full length of the belt.

9. The apparatus of claim 1, wherein the reinforcement portion extends a partial length of the belt and is arranged to provide reinforcement at a predetermined area of the belt.

10. The apparatus of claim 1, wherein the reinforcement portion comprises multiple regions having an added layer disposed between the two outer layers of the belt.

11. The apparatus of claim 1, wherein a thickness or a width of the reinforcement portion varies along a length of the reinforcement portion according to a predetermined pattern, and determines a rigidity or a flexibility of the reinforcement portion according to the predetermined pattern.

12. The apparatus of claim 1, wherein a layer of the reinforcement portion is comprised of titanium.

13. The apparatus of claim 1, wherein the multi-layered belt comprises a plurality of layers including one or more metallic layers and one or more adhesive layers, disposed between the two outer layers of the belt.

14. The apparatus of claim 1, wherein the plurality of parallel strips includes at least one layer of an aramid material.

* * * * *